US007059422B2

(12) United States Patent
Burgin

(10) Patent No.: US 7,059,422 B2
(45) Date of Patent: Jun. 13, 2006

(54) SELF-ORIENTING LOADER BUCKET MECHANISM

(76) Inventor: Bobby Gene Burgin, P.O. Box 205, Groom, TX (US) 79039

( * ) Notice: Subject to any disclaimer, the term of this patent is extended or adjusted under 35 U.S.C. 154(b) by 169 days.

(21) Appl. No.: 10/831,715

(22) Filed: Apr. 26, 2004

(65) Prior Publication Data

US 2005/0241193 A1 Nov. 3, 2005

(51) Int. Cl.
*A01B 15/14* (2006.01)

(52) U.S. Cl. ..... 172/776; 172/274

(58) Field of Classification Search ..... 37/348, 37/414, 382; 414/699–701; 701/50; 172/1–6, 172/10, 700, 272–275, 776, 274
See application file for complete search history.

(56) References Cited

U.S. PATENT DOCUMENTS

| | | | | | |
|---|---|---|---|---|---|
| 2,883,077 | A * | 4/1959 | Pilch | 414/700 |
| 3,122,247 | A * | 2/1964 | Beck | 414/701 |
| 3,220,581 | A * | 11/1965 | Pedersen et al. | 414/708 |
| 3,265,229 | A * | 8/1966 | Koch | 414/701 |
| 3,521,781 | A * | 7/1970 | Holsinger et al. | 414/701 |
| 3,529,740 | A * | 9/1970 | Chant | 414/711 |
| 3,534,881 | A * | 10/1970 | Horsch | 414/699 |
| 3,536,216 | A * | 10/1970 | Woolman et al. | 414/694 |
| 3,698,583 | A * | 10/1972 | Shore | 414/701 |
| 3,862,697 | A * | 1/1975 | Gill et al. | 414/700 |
| 3,952,896 | A * | 4/1976 | Hayward | 414/708 |
| 4,266,909 | A * | 5/1981 | Langenfeld et al. | 414/700 |
| 4,301,607 | A * | 11/1981 | Inui | 37/415 |
| 4,324,525 | A * | 4/1982 | Lane et al. | 414/699 |
| 4,354,797 | A * | 10/1982 | Hirose et al. | 414/700 |
| 4,372,729 | A * | 2/1983 | Buschbom et al. | 414/700 |
| 4,825,568 | A * | 5/1989 | Kawamura et al. | 37/442 |
| 4,844,684 | A * | 7/1989 | Bradley | 414/528 |
| 5,184,932 | A * | 2/1993 | Misuda et al. | 414/685 |
| 5,609,464 | A * | 3/1997 | Moffitt et al. | 414/685 |
| 5,678,979 | A * | 10/1997 | Kovacs | 414/700 |
| 5,782,018 | A * | 7/1998 | Tozawa et al. | 37/348 |
| 6,132,163 | A * | 10/2000 | Andrews et al. | 414/685 |
| 6,246,939 | B1 * | 6/2001 | Nozawa | 701/50 |
| 6,609,315 | B1 * | 8/2003 | Hendron et al. | 37/348 |
| 6,912,804 | B1 * | 7/2005 | Charles | 37/348 |
| 2004/0028514 | A1 * | 2/2004 | Mimuro | 414/685 |

* cited by examiner

*Primary Examiner*—Thomas B. Will
*Assistant Examiner*—Toni Newville

(57) ABSTRACT

A mechanism for retaining a pre-selected orientation of a front-end loader bucket at all points throughout the working range of the lift arm assembly includes a linkage system designed to allow rotation of the bucket from a tilted back position to a fully dumped position throughout the range of the lift arm assembly without limiting the range of the lift arm assembly and to provide strength and mechanical integrity to its components at any orientation of the lift arm assembly or the bucket. At extreme raised position the bucket is able to be rotated from a full tilted back orientation to a dumping orientation that allows the floor of the dumped bucket to approach or achieve a position perpendicular to the plane upon which the loader vehicle is standing or assuming the vehicle is on a level plane the orientation of the bucket would be considered as straight down. As the bucket rotates zthrough the dumping process components of the linkage system travel a path over and beyond the end of the raised lift arm assembly maintaining favorable mechanical advantage over the bucket throughout its rotation. At the extreme lowered position of the lift arm assembly the bucket can be rotated from a full tilted back orientation to a position past straight down which is desirable when performing certain operations with a front-end loader. The design of the bucket orienting mechanism is paramount in allowing the combination of all the afore mentioned maneuvers and is therefore considered as the invention.

1 Claim, 7 Drawing Sheets

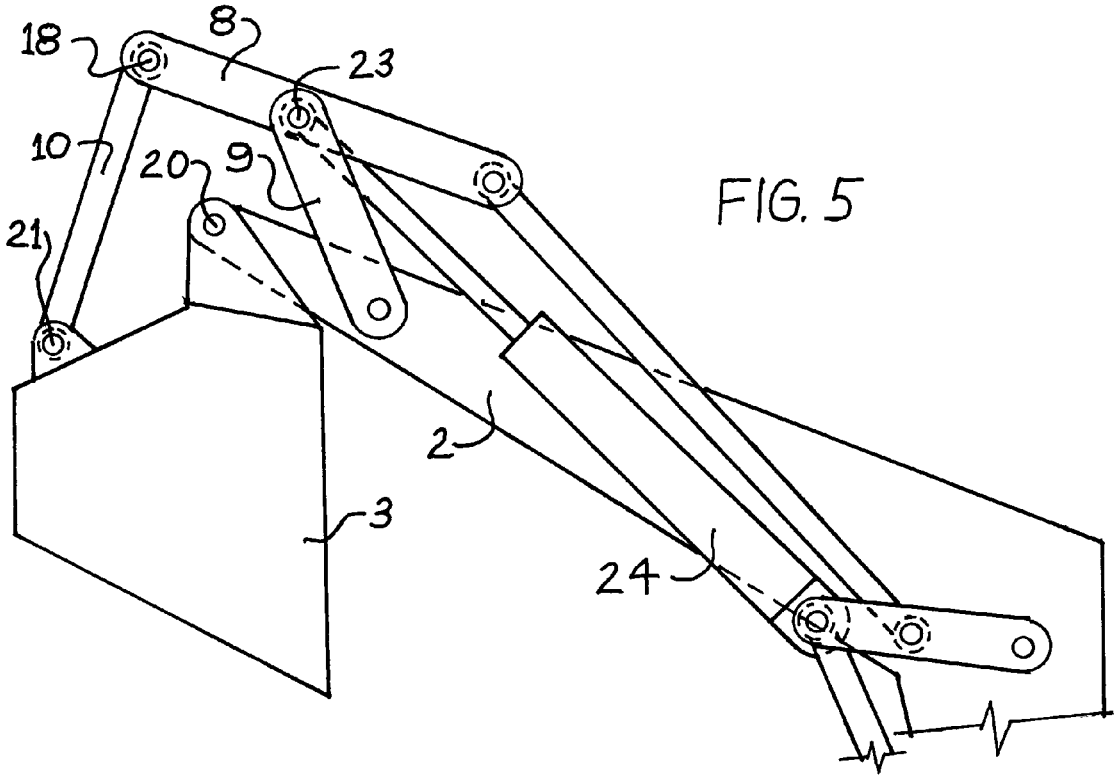
FIG. 5
FIG. 6
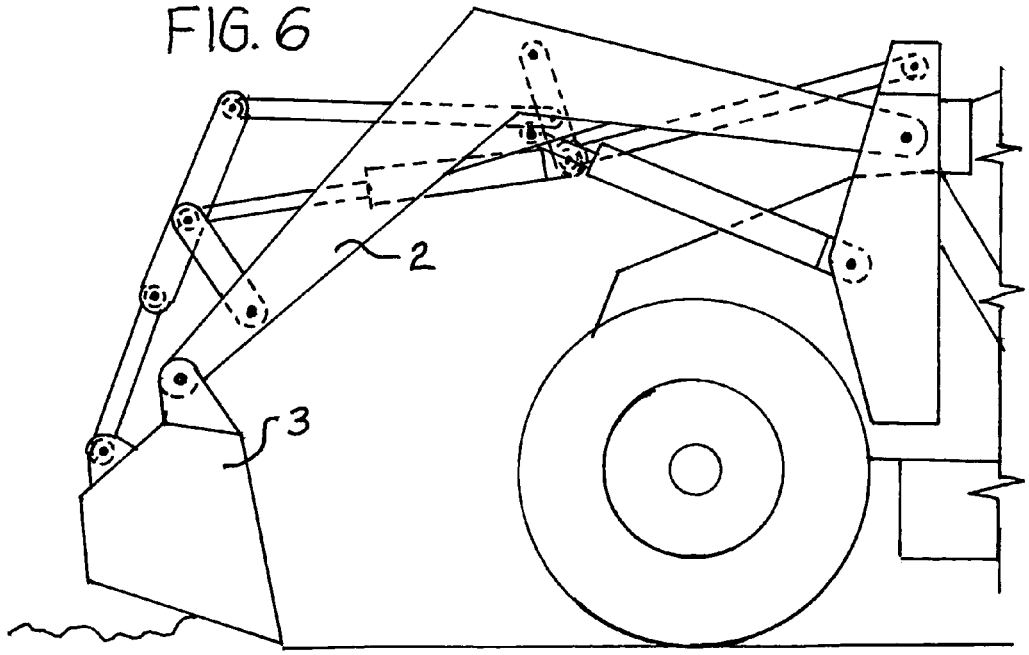

SELF-ORIENTING LOADER BUCKET MECHANISM

BACKGROUND OF THE INVENTION

Front-end loaders are machines designed to relocate, lift, and dump a variety of materials. A vehicle can be manufactured expressly for the purpose or an existing tractor can be equipped with a loader attachment. The front-end loader will have a lift arm assembly pivotally attached at one end to the vehicle and pivotally attached at the other end to a bucket or other type of material handling implement. Hydraulically actuated lift cylinders pivotally mounted at one end to the lift arm assembly and pivotally mounted at the remaining end to the frame of the vehicle or tractor raise and lower the lift arm assembly with hydraulic pressure received from a hydraulic system established on the vehicle. Tilting or dumping of the material handling device is accomplished by the extension or retraction of the hydraulically actuated bucket tilting cylinder or cylinders acting through arms and links attached at a pivot point or the material handling implement or bucket on one end and on the other end to a pivot point located static to the vehicle. These arms and links in series with the hydraulic cylinder are designed and located to maintain a substantially fixed and pre-selected orientation of the bucket throughout the raising and lowering cycle of the lift arm assembly.

Many self-orienting designs place limitations upon the maximum amount of rotation allowed the lift arm assembly and bucket. Usually to accomplish the desired operation at either the extreme lowered or raised position of the lift arms a compromise situation is experienced at the other extreme position. That is to say that a self-orienting bucket design that has a favorable angle between the bucket actuating mechanism and the bucket at extreme tilt-back position when lift arms are lowered to extreme position can experience a problem with interference and or critical angles between components of the linkage, lift arms, and bucket when lift arms are raised to extreme limits and the bucket is tilted down or dumped to extreme position. Considerations must be made in the design of the linkage mechanism substituting desirability with acceptability.

Another disadvantage with some designs is the extreme upper and lower travel of the lift-arm assembly is restricted by limitations of the self-orienting mechanism and not the physical limits that exist between the lift arm assembly and the vehicle.

Limitations common to many self-orienting loader designs occur while the lift arm assembly is fully raised not allowing the bucket to achieve a filly dumped orientation before the bucket-tilting cylinder reaches maximum extension. Most stop considerably short of straight down making it difficult to dump materials that tend to stick and not slide from the dumped bucket.

Improvements to the above-described problem areas realized through a unique self-orienting bucket mechanism will be an enhancement to the current art.

BRIEF SUMMARY OF THE INVENTION

The objective of this invention is to develop a self-orienting bucket mechanism that overcomes some specific problems that exist in the front-end loader field. Consideration is given to improving the areas that limit travel of the lift arms and restrict the rotation of the bucket as well as eliminating critical angles the mechanism may experience during extreme dump or extreme roll back orientation of the bucket.

This invention introduces a design that allows a high degree of rotation of the lift arms, a full dumping of the bucket at all positions of the lift arms, and a linkage system that offers a favorable advantage to its components at all positions while maintaining a substantially fixed orientation of the bucket.

Restrictions common in other front-end loader designs that occur when the lift arms are in full raised position and the bucket is rotated to a dumped position do not exist with this self-orienting mechanism. The ability of the components to extend over and above the bucket allows it to achieve an orientation of straight down while avoiding any critical angles.

Being given an afore described situation with the lift arms fully raised as the dumping bucket approaches a straight down orientation interference between it and the underside of the lift arms will occur. This is an unavoidable condition common to the front-end loader field. The restriction this occurrence places upon the maximum stroke of the bucket-tilting cylinder will also limit the full downward tilt of the bucket when the lift arms are lowered. The design of the bucket orienting mechanism set forth in this invention prevents such a restriction to the stroke of the bucket-tilting cylinder with lift arms fully raised. The part of the mechanism being controlled by the extending bucket tilting cylinder assumes a path that neutralizes or near stops movement of the bucket even while the cylinder continues to extend to maximum stroke. Thus the rotation of the bucket ceases just prior to its experiencing an interference condition with the underside of the lift arm. While this control over bucket rotation is of favorable consequence when lift arms are in the fully-raised position also as the lift arms are lowered the area of interference between them and the bucket widens allowing the mechanism to automatically orient the bucket to a position of past straight down. Past straight down being a desirable position when using the tip of the dumped bucket as a blade for smoothing uneven or rough material. This past straight down orientation of the bucket is achievable as a result of the amount the bucket tilting cylinder is allowed to extend after the neutral path is assumed by the mechanism with respect to the dumped bucket while lift arms are fully raised.

BRIEF DESCRIPTION OF THE SEVERAL VIEWS OF THE DRAWINGS

FIG. 5 illustrates how components of the mechanism are positioned favorably to control the dumped bucket when the lift arms assembly is fully raised.

FIG. 6 illustrates that the mechanism is able to orient the bucket past straight down when the lift arm assembly is a lowered position.

DETAILED DESCRIPTION OF THE INVENTION

Improvements offered by this invention are contained in the area within the front-end loader field relevant to controlling the orientation of the bucket or material handling attachment. The front-end loader being a machine designed to load, lift, and relocate a variety of materials. It generally consists of a lift arm assembly pivotally attached at one end to a tractor or vehicle and pivotally attached at the other end to a bucket or material handling device. Hydraulically operated cylinders pivotally attached at one end to a point on the lift arm assembly and the other end pivotally attached to the tractor or vehicle raise and lower the lift arm assembly as desired. As the lift arms raise and lower it is desirable to maintain a fixed orientation of the bucket preventing spillage of the loaded material. The bucket must also be able to rotate to a dumping orientation and return at any given height of the lift arm assembly. Maintaining the fixed orientation of the bucket and rotating it to a dumping orientation is accomplished through a mechanism that links to a pivot point on the bucket at one end and to a pivot point static to the tractor or vehicle on the other end. A hydraulic cylinder will be included in this mechanism for the purpose of orienting the bucket to a desired position.

Figure 1:
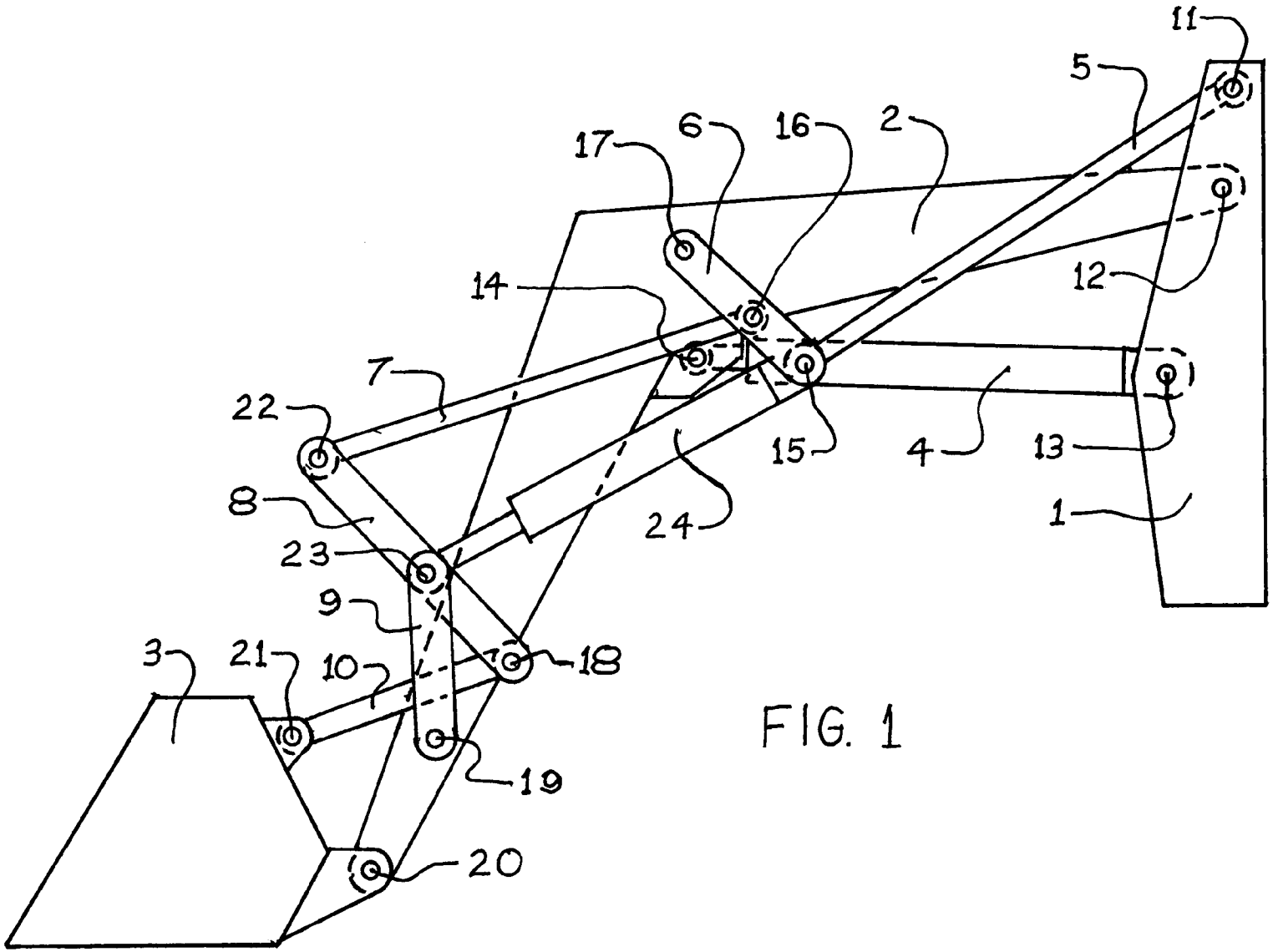
FIG. 1 is a side view of a loader attachment showing the self-orienting bucket mechanism as viewed from the center of the lift arm assembly.

Improvements to the area within the front-end loader field that relate to controlling the orientation of the bucket or material handling attachment are offered by this invention and are contained in the unique design of a self-orienting bucket mechanism. The components of the mechanism are shown in FIG. 1 and the following description details the advantages new to the field. An upright bracket 1 is mounted to the tractor or vehicle. The lift arm assembly 2 is joined to the upright bracket 1 at pivot point 12. The material handling bucket 3 is joined to the lower end of the lift arm assembly 2 at pivot point 20. The hydraulic lift cylinder 4 connects on one end to the upright bracket 1 at pivot point 13 and at the other end to the lift arm assembly 2 at pivot point 14.

A rotating arm 6 is attached at one end to lift arm assembly 2 at pivot point 17. The opposite end of rotating arm 6 shares pivot point 15 with one end of connecting link 5 and one end of the bucket-tilting cylinder 24. The opposite end of connecting link 5 is connected to the upright bracket 1 at pivot point 11. Intermediate to the ends of rotating arm 6 one end of connecting link 7 attaches to rotating arm 6 at pivot point 16. The remaining end of connecting link 7 is attached to one end of control arm 8 at pivot point 22. The opposite end of control arm 8 is attached to one end of connecting link 10 at pivot point 18 while the remaining end of connecting link 10 is attached to the bucket 3 at pivot point 21. Intermediate the ends of control arm 8 is pivot point 23. Pivot point 23 is shared by control arm 8, the remaining end of the bucket tilt cylinder 24, and one end of positioning arm 9. The remaining end of positioning arm 9 is attached to the lift arm assembly 2 at pivot point 19.

Very important to the design of this mechanism is the location of the bucket tilt cylinder 24 as it is afforded the ability to re-orient components by changing the location of positioning arm 9 as it extends or retracts.

Figure 2:
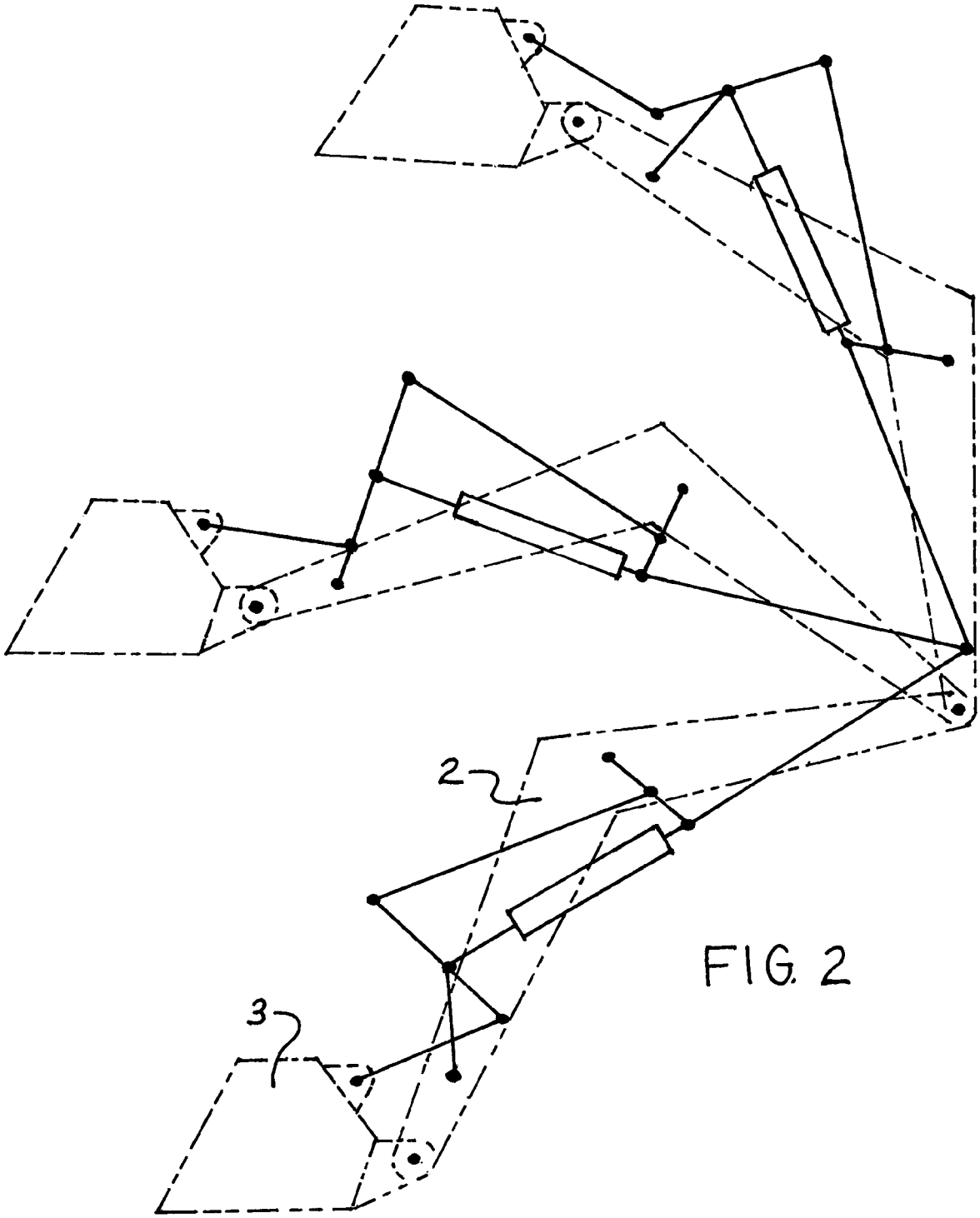
FIG. 2 shows the positioning of the mechanism at three different heights of the lift arm assembly while maintaining a level bucket orientation and not limiting the extreme raised or lowered positions of the lift arm assembly. For clarity the bucket orienting mechanism is shown in schematic form and the lift cylinder has been omitted.
Figure 3:
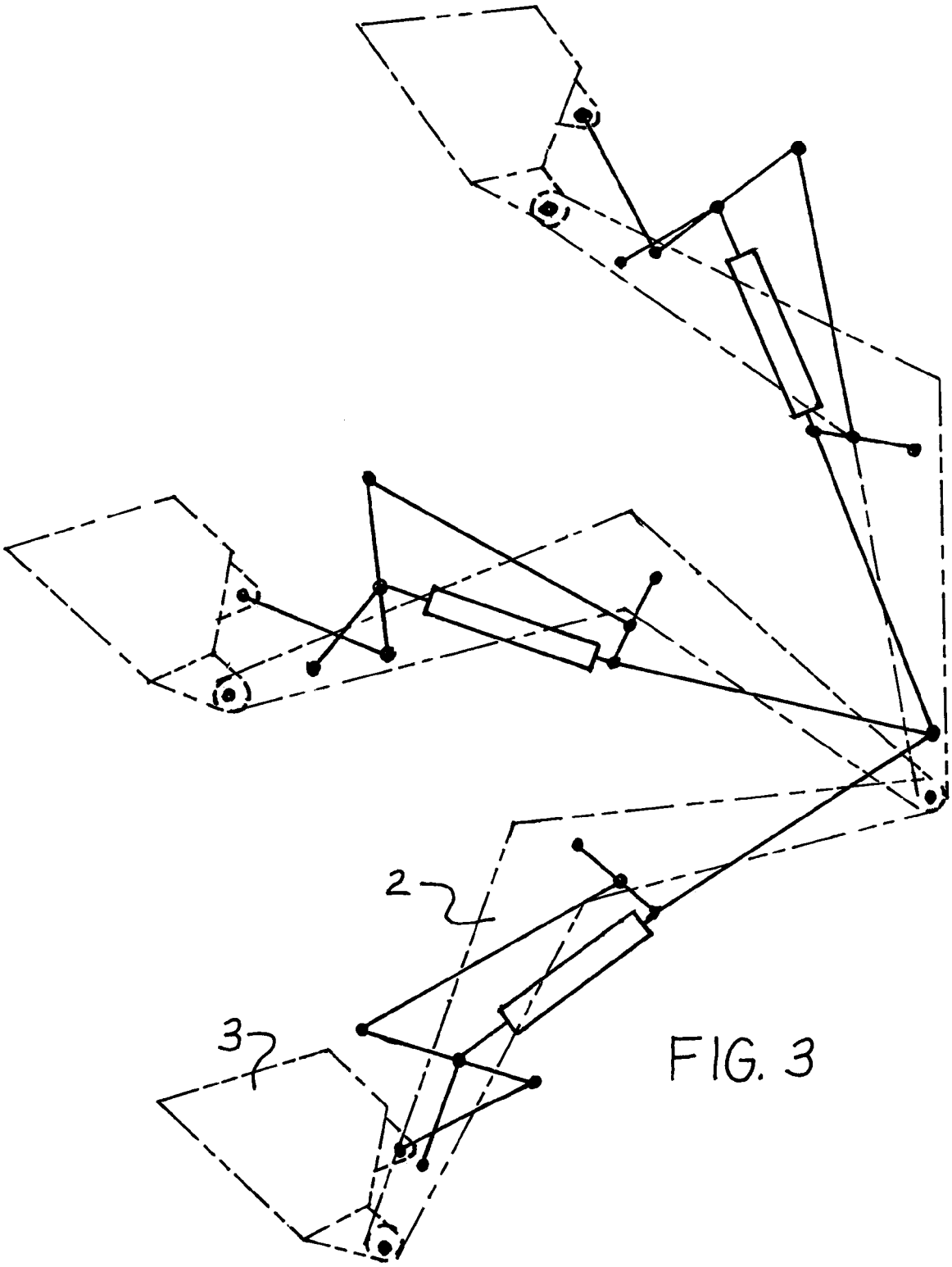
FIG. 3 is identical to FIG. 2 except the bucket is shown maintaining a rolled back orientation.
Figure 4:
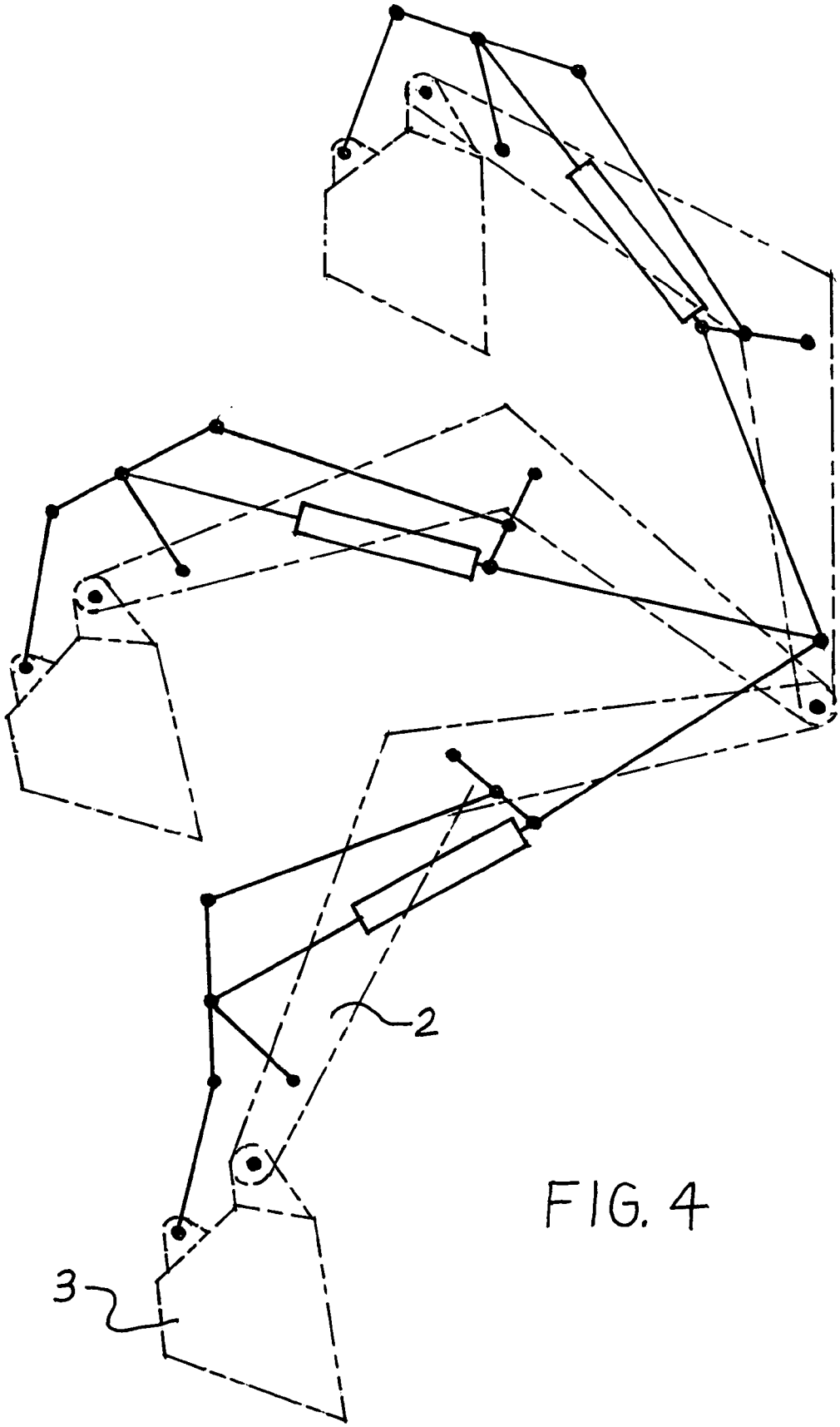
FIG. 4 is identical to FIG. 2 except the bucket is shown maintaining a fully dumped orientation.

The following account details how this mechanism maintains a pre-selected orientation of the bucket 3 as the lift arm assembly 2 is raised. As a result of the extension of lift cylinder 4, the lift arm assembly 2 rotates around the axis of pivot point 12 and the bucket end of the lift arm assembly 2 rises. As the lift arm assembly 2 rotates, the relationship between it and pivot point 11 changes creating movement delivered by connecting link 5 to rotating arm 6. As arm 6 rotates, the bucket tilt cylinder 24 and connecting link 7 are advanced by an amount proportional to the location of pivot points 15 and 16. The advancing bucket tilt cylinder 24 acts upon pivot point 23 rotating positioning arm 9 while connecting link 7 delivers its motion to control arm 8 at pivot point 22. Control arm 8 is rotated about pivot point 23 advancing pivot point 18, connecting link 10, and pivot point 21 the required amount to maintain the orientation of bucket 3 throughout the range of the lift arm assembly 2. While FIG. 1 depicts a level bucket orientation with the lift arm assembly 2 in a lowered position FIG. 2, FIG. 3, and FIG. 4 of the drawings shows three different bucket orientations being substantially maintained at points throughout the range of the lift arm assembly 2. FIG. 2 depicts a level bucket orientation, FIG. 3 a rolled back orientation, and FIG. 4 a dumping orientation. While viewing FIGS. 2, 3, and 4 it can be noted that the range of the lift arm assembly 2 approaches practical limits at both the extreme raised and extreme lowered positions. The design allows the self-orienting mechanism to control the orientation of the bucket 3 while providing a favorable mechanical advantage to all components without restricting the range of the lift arm assembly 2.

FIG. 5 illustrates the position the linkage assumes when the lift arm assembly 2 is raised to extreme limits and the bucket 3 is rotated downward or dumped to extreme limits. Unfavorable conditions experienced by other front-end loader designs at said positioning of lift arm assembly and bucket are avoided by this design. These conditions include critical angles, undesirable forces, and interference between components that will restrict the orientation of the dumped bucket. As can be seen in FIG. 5, the positioning arm 9 is rotated to an orientation that positions pivot point 23 well above the bucket pivot point 20 allowing pivot point 18 of control arm 8 to be positioned favorably with respect to bucket 3 as it relates to pivot point 21 through connecting link 10. Thus a fully dumped bucket orientation is realized while forces exerted upon the components, including the bucket tilt cylinder 24, are not critical.

Figure 7:
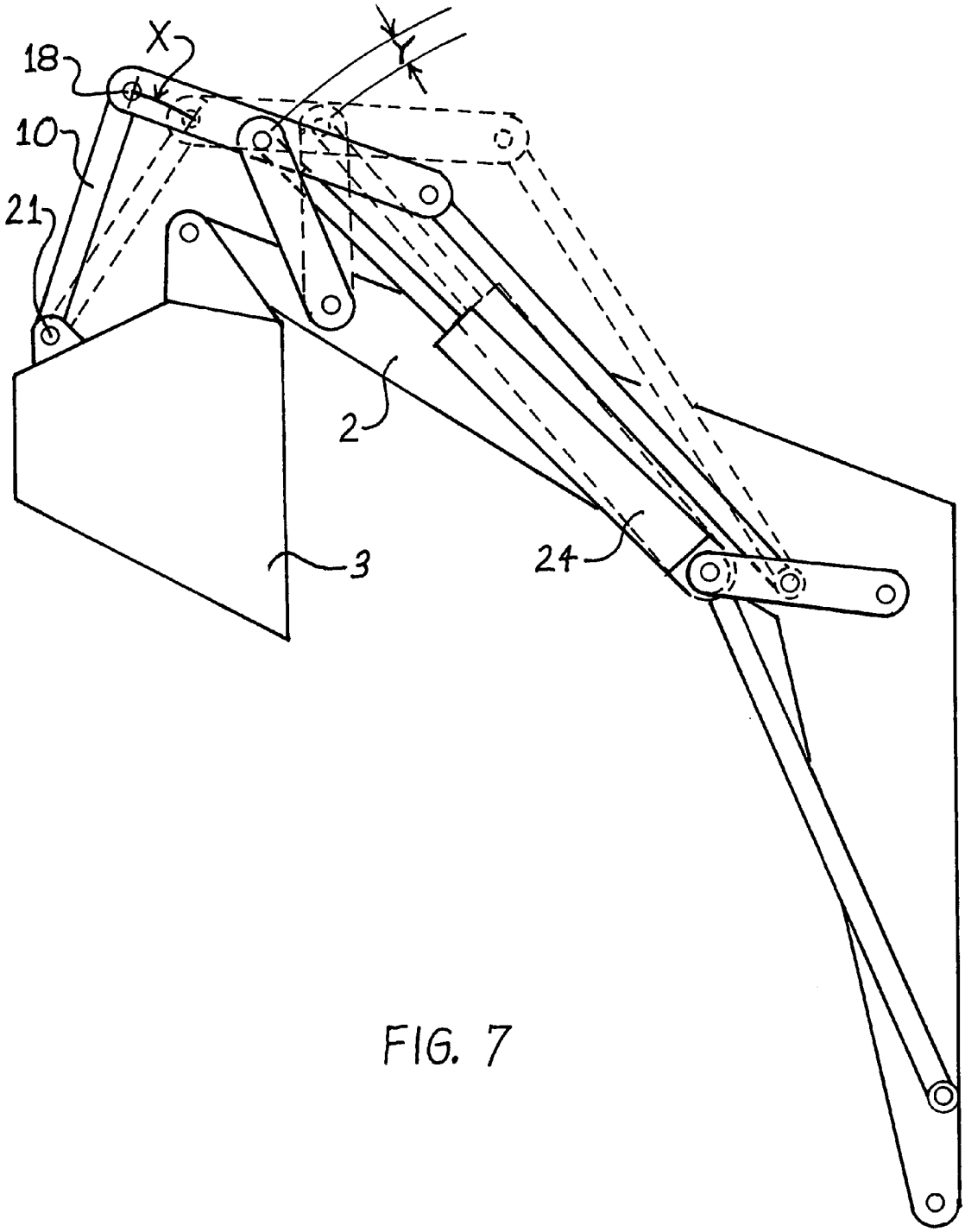
FIG. 7 is an alternate position view illustrating how a greater maximum stroke of the bucket-tilting cylinder 24 is allowed by the mechanism with the lift arms fully raised.

FIG. 6 depicts a situation whereas the lift arm assembly 2 is lowered to a point that allows the tip of the fully dumped bucket 3 to engage in operations such as smoothing or leveling of materials. As can be noted in FIG. 6 the bucket orienting mechanism allows the bucket 3 to be rotated to a position that somewhat exceeds a straight down orientation making the afore mentioned operations more easily accomplished. A bucket orientation of past straight down for these working conditions is actually allowed by events that occur during the bucket dump cycle with the lift arm assembly 2 fully raised as shown in FIG. 7. As tilt cylinder 24 extends, positioning arm 9 rotates about pivot point 19, advancing pivot point 18 and connecting link 10 toward pivot point 21 and the dumping cycle from extreme tilt back position to dumped position begins. FIG. 7 is an alternate position view illustrating how a greater maximum stroke of bucket tilting cylinder 24 is allowed by the mechanism toward the end of this cycle. As bucket 3 reaches an orientation of approximately straight down interference between it and the lower side of the lift arm assembly 2 becomes imminent and no further rotation is possible. At this point, however, the bucket-tilting cylinder 24 is not fully extended and continues to advance the mechanism as previously described except that pivot point 18 assumes a curved path (designated X in FIG. 7) that maintains approximately an equal distance from pivot point 21. Thus no movement is delivered to pivot point 21 through connecting link 10 and rotation of bucket 3 effectively stops as bucket tilting cylinder 24 continues to extend to the maximum length. The amount by which the bucket tilting cylinder 24 extends after bucket 3 stops (designated Y in FIG. 7) allows bucket 3 to rotate to past straight down orientation when the lift arm assembly 2 is lowered.

Figure 8:
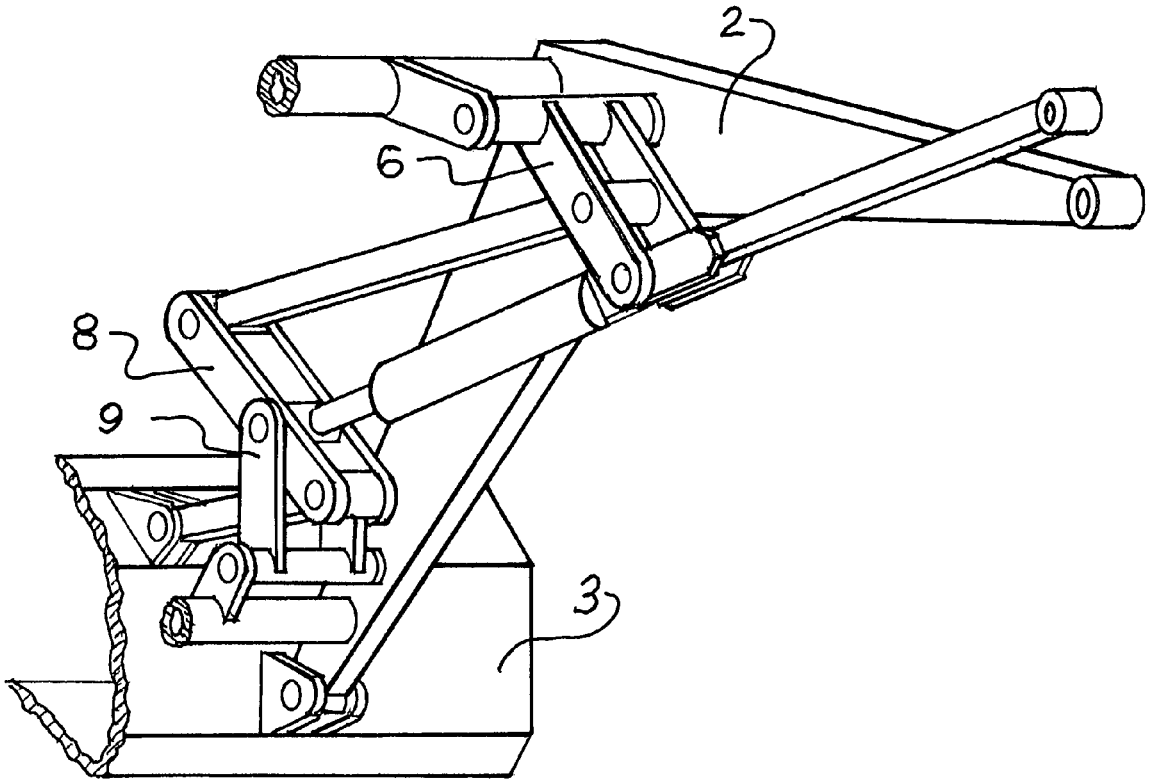
FIG. 8 is a perspective view presenting a preferred embodiment of the self-orienting bucket mechanism.

A perspective view of a preferred embodiment of this self-orienting bucket mechanism is presented in FIG. 8. Whereas the cut-away portion of the lift-arm assembly 2 and the bucket 3 would mirror the portion shown to include a second self-orienting bucket mechanism working in parallel with the embodiment shown. FIG. 8 also reveals how rotating arm 8, and positioning arm 9 would be configured in a preferred embodiment. While different embodiments can be perceived the basic relationship of the components, one to another, as shown in all the presented drawings and which has been detailed in the preceding description is key to establishing all declarations made in this presentation.

I claim:

1. A self-orienting loader bucket mechanism for controlling bucket orientation of a front-end loader whereas said front-end loader is so designed as to consist of:

a lift-arm assembly being pivotally attached on one end to a vehicle and being pivotally attached to a bucket or other load carrying device on the remaining end;

a hydraulic lift cylinder being pivotally attached on one end to a point on said vehicle and the remaining end being pivotally attached to a point on said lift-arm assembly;

and said mechanism for controlling bucket orientation comprising:

a rotating arm being attached on one end to said lift-arm assembly at a first pivot point located intermediate the ends of said lift-arm assembly;

a second pivot point at the remaining end of said rotating arm being commonly shared by one end of a hydraulic bucket tilting cylinder and one end of a first connecting link with the remaining end of the first connecting link originating at a third pivot point being static to said vehicle;

a second connecting link being attached on one end at a fourth pivot point intermediate the ends of said rotating arm while the remaining end of said second connecting link shares a fifth pivot point with the upper end of a control arm;

a sixth pivot point located at the lower end of said control arm is commonly shared with one end of a third connecting link, with the remaining end of said third connecting link being attached to said bucket at a seventh pivot point;

an eighth pivot point located intermediate the ends of said control arm is commonly shared by the remaining end of said hydraulic bucket tilting cylinder and one end of a positioning arm, with the remaining end of said positioning arm being attached at a ninth pivot point located on said lift-arm assembly.

* * * * *